US007648772B2

(12) United States Patent
Grant et al.

(10) Patent No.: US 7,648,772 B2
(45) Date of Patent: Jan. 19, 2010

(54) MOISTURE RESISTANT CONTAINER

(75) Inventors: Terry M. Grant, Auburn, WA (US); David W. Park, Puyallup, WA (US)

(73) Assignee: International Paper Co., Memphis, TN (US)

( * ) Notice: Subject to any disclaimer, the term of this patent is extended or adjusted under 35 U.S.C. 154(b) by 489 days.

(21) Appl. No.: 11/170,582

(22) Filed: Jun. 28, 2005

(65) Prior Publication Data

US 2006/0289135 A1 Dec. 28, 2006

(51) Int. Cl.
*B32B 29/06* (2006.01)
*B32B 29/08* (2006.01)

(52) U.S. Cl. ..... 428/531; 428/212; 428/524; 428/526; 428/527; 428/165; 428/156; 162/125; 162/123; 162/127; 162/147; 162/164.3; 156/210

(58) Field of Classification Search ..... 428/212, 428/537.5, 524, 526–527, 165, 156; 162/125, 162/123, 127, 147, 164.3
See application file for complete search history.

(56) References Cited

U.S. PATENT DOCUMENTS 3,687,767 A * 8/1972 Reisman et al. ..... 156/210
3,819,470 A * 6/1974 Shaw et al. ..... 162/157.6
5,981,044 A * 11/1999 Phan et al. ..... 428/212
6,669,814 B2 * 12/2003 Hansen et al. ..... 162/129

FOREIGN PATENT DOCUMENTS

WO WO95/26411 A1 * 10/2005

OTHER PUBLICATIONS

Poustis, J. (edited by Kirwan). "Paper and Paperboard Packaging Technology". Blackwell Publishing, (2005), pp. 317-372.*

* cited by examiner

*Primary Examiner*—David R Sample
*Assistant Examiner*—Prashant J Khatri
(74) *Attorney, Agent, or Firm*—Amy L. Miller; Matthew M. Eslami

(57) ABSTRACT

A sheet of cellulose based material having enhanced strength, particularly the dry strength, substantially unaffected repulpability is disclosed. The sheet of cellulose based materials generally includes a first cellulose based material connected with a second cellulose base material element. The first cellulose based material is formed by separating a portion of the fiber from a furnish, treating the separated portion with a cationic wet strength resin which is allowed to bond to the fiber. The treated fiber is them mixed with the untreated balance of the fiber at some point before the paper machine. The fiber that is separated may be secondary fiber, virgin fiber or combinations thereof. The second cellulose base material element is substantially free from any treatment. The second cellulose base material element may be include substantially all untreated fibers.

6 Claims, 10 Drawing Sheets

MOISTURE RESISTANT CONTAINER

FIELD OF THE INVENTION

The embodiments relate generally to cellulose based products and, more specifically to cellulose based products having good strength characteristics and repulpability.

BACKGROUND OF THE INVENTION

Containers made from fibreboard are used widely in many industries. For example, fibreboard containers are used to ship products that are moist or packed in ice such as fresh produce or fresh seafood. It is known that when such containers take up moisture, they lose strength. To minimize or avoid this loss of strength, moisture-resistant shipping containers are required.

Moisture-resistant containers used to date have commonly been prepared by saturating container blanks with melted wax after folding and assembly. Wax-saturated containers cannot be effectively recycled and must generally be disposed of in a landfill. In addition, wax adds a significant amount of weight to the container blank, e.g., the wax can add up to 40% by weight to the container blank.

BRIEF DESCRIPTION OF THE DRAWINGS

The embodiments of the present invention are described in detail below with reference to the following drawings.

DETAILED DESCRIPTION OF THE INVENTION

The present invention provides a sheet of cellulose based material that has increased moisture resistance and strength retention without adversely effecting repulpability. By way of overview and with references to FIGS. 1-3, an embodiment of the present invention includes a cellulose based material formed from first cellulose based material element 22 and a second cellulose based material element 24. Optionally, a third cellulose based material element 26 may be also be included. It will be a appreciated that any number of additional sheets may be added without exceeding the spirit and scope of this invention. The various cellulose based material elements are joined together to form a sheet of cellulose based material 20, that may be cut, scored, folded or otherwise formed into a variety of items. Specific details of the cellulose based material 20 are described with more particularity below.

An aspect of present invention provides for the formation of a cellulose based material formed from cellulose materials such as wood pulp, straw, cotton, bagasse and the like. Cellulose based materials useful in the present invention come in many forms such as fibreboard, containerboard, corrugated containerboard and paperboard. The cellulose based materials can be formed into structures such as container blanks, tie sheets, slipsheets and inner packings for containers. Examples of inner packings include shells, tubes, U-boards, H-dividers and corner boards. The following discussion proceeds with reference to an exemplary cellulosic based material in the form of a containerboard blank, but it should be understood that the present invention is not limited to containerboard blanks.

Containerboards are one example of cellulose based materials useful in the present invention. Particular examples of containerboard include single face corrugated fibreboard, single-wall corrugated fibreboard, double-wall corrugated fibreboard, triple-wall corrugated fibreboard and corrugated fibreboard with more walls. The foregoing are examples of cellulose based material and forms the cellulose based material may take that are useful in accordance with the methods of the present invention; however, the present invention is not limited to the foregoing forms of cellulose based materials. Specific details of the cellulose based material 20 are described with more particularity below.

Figure 1:
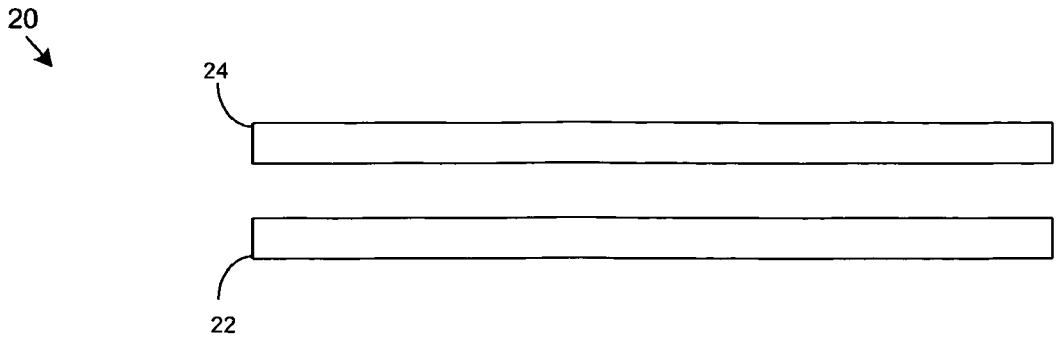
FIG. 1 is an exploded side view of a cellulose based material made in accordance with an aspect of the present invention.
Figure 2:
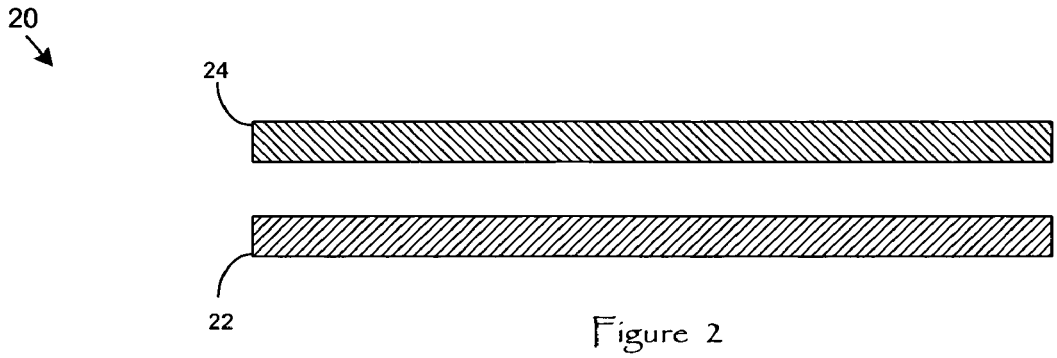
FIG. 2 is another side view of a cellulose based material made in accordance with an aspect of the present invention.

Referring to FIGS. 1 and 2, generally disclose a cellulose based material 20 formed from first cellulose based material element 22 and a second cellulose based material element 24. As depicted, the first cellulose based material 22 is formed via a fiber pretreatment process described in more detail below. Generally, the fiber of the first cellulose based material element 22 includes from 5-40% of the fiber treated with 0.5-5.0% of a reactive crosslinking-type wet strength resin additive uniformly blended with 95-60% of untreated fiber. The fibers that are treated may be all secondary fiber, virgin fibers or combinations thereof. The resin in this process is at least partially crosslinked. Variations and the details of this treatment process are described in more detail below.

The second cellulose based material element 24 is not subjected to this fiber pretreatment process. The second cellulose based material element 24 may be any plain, untreated sheet of cellulose based material. However, the second cellulose based material element 24 may include any number of other known paper coating/treating processes. For example, without limitation, the second cellulose based material element 24 may include coatings of polymers used in barrier coatings, which are, for example, polymers or copolymers of styrene, acrylate, methyacrylate, butadiene, or vinyl acetate. However, it will be appreciated other coatings known in the art may also be used. One suitable non-limiting example of such polymers and copolymers is polyamid-epichlorohydrin manufactured by Hercules under the trademark Kemene® 557H. Additionally, strictly by way of further example, any variety of known surfactants may be added to enhance the colloidal stability of the dispersion. The polymers or copolymers may be carboxylated to improve a number of properties.

The second cellulose based material element 24 may include a number of other treatments/coatings as well. By way of further, non-limiting example, a Wax Alternative Medium (WAM) such as that manufactured by Spectra-kote® may also be present in the second cellulose based material element 24. WAM is generally a kraft medium with sizing, wet strength chemical and acrylic polymer. Sizing can come from AKD (Alkyl Ketene Dimers), ASA (Alkenyl Succinic Anhydride) or Rosin. Additionally, sizing may come from any other known source. Kymene is the typical wet strength resin that may be included in the second cellulose based material element 24. In another embodiment, standard specialty cellulose material additives such as sizing, either with or without wet strength may be used. Similarly, if it is desired, a wax, such as hydrocarbons or esters of fatty acids and alcohol, may be applied to the second cellulose based material element 24.

Figure 3:
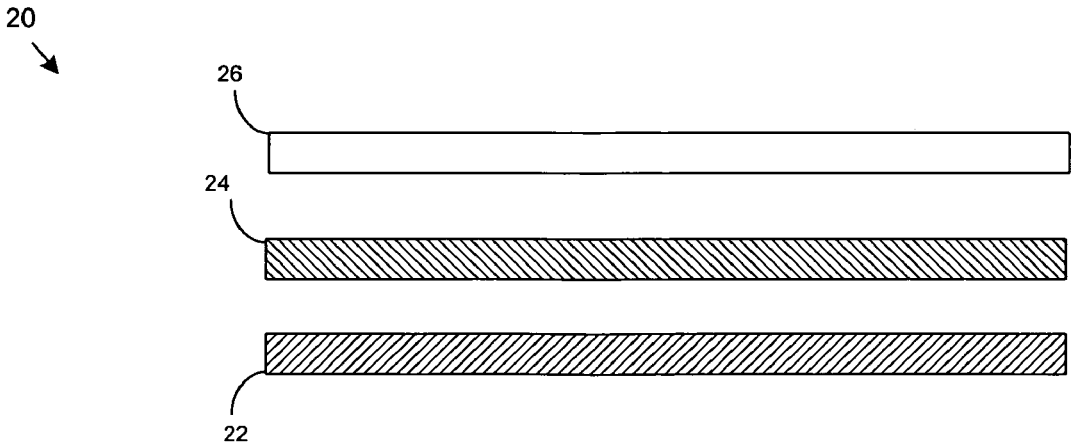
FIG. 3 is another side view of a cellulose based material made in accordance with an aspect of the present invention.

As best seen in FIG. 3, an optional third cellulose based material element 26 may be included. The third cellulose based material element 26 may be a fiber pretreated cellulose element, such as the first cellulose based material element 22, or it may be a substantially non-fiber pretreated cellulose element such, as the second cellulose based material element 24. If the third cellulose based material element 26 is not a fiber pre-treated cellulose element, it may be either a plain cellulose based material or it may be coated/treated with any processes or products discussed above with respect the second cellulose based material element 24.

With regards to structure, the various cellulose based material elements may be either substantially flat or they may be fluted, or any combination thereof. For example, the first cellulose based material 22 may be fluted and the second cellulose based material 24 may not be fluted, or vice versa. Further, if a third cellulose based material 26 is present, it may be fluted or not. The first cellulose based material element 22, second cellulose based material element 24 and optional third cellulose based material element 26 may be arranged relative to each other in any order to achieve any of the cellulose base material forms discussed above.

Figure 4:
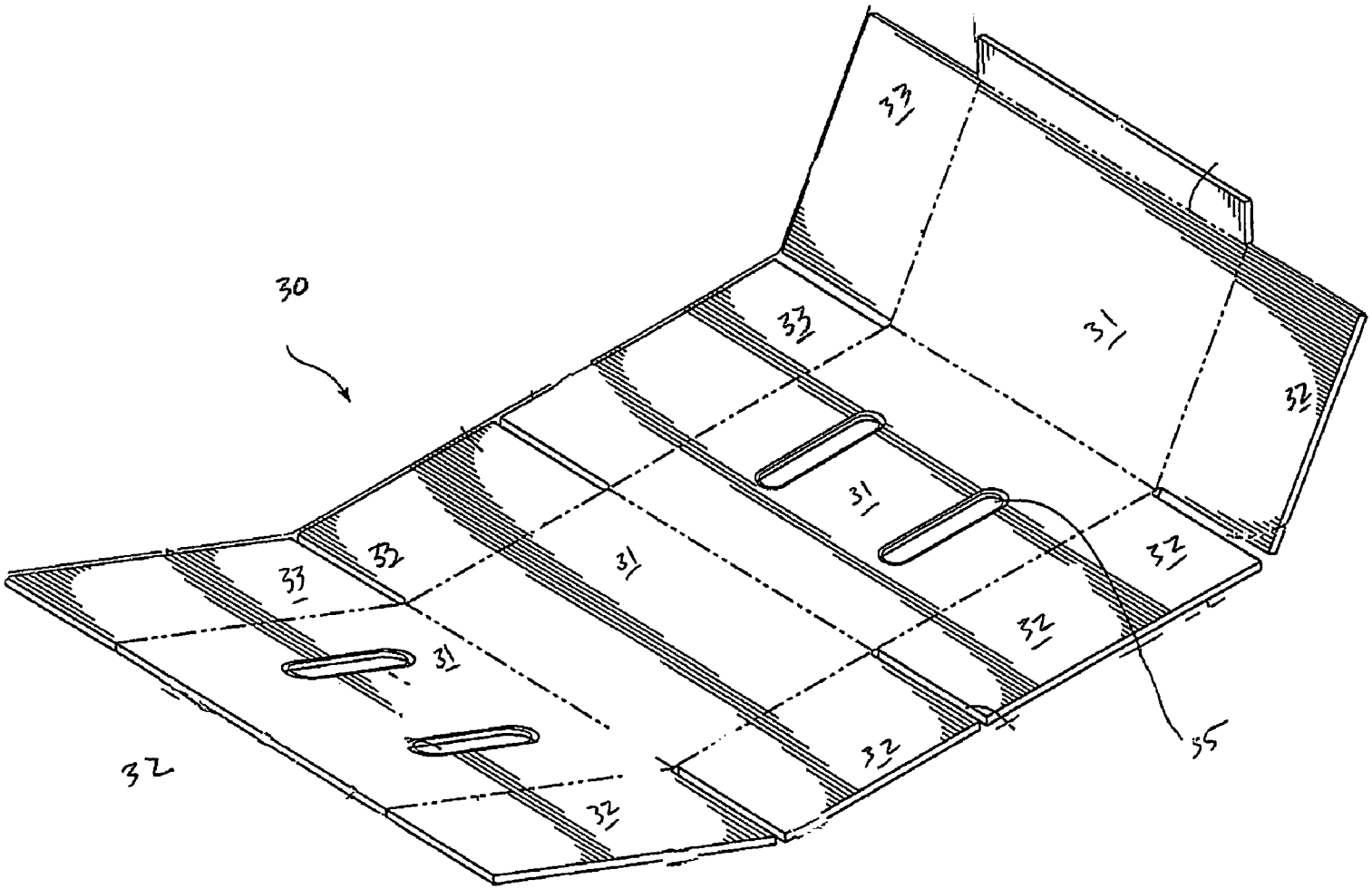
FIG. 4 is a perspective view of a cellulose based material in the form of a container blank according to an aspect of the present invention.
Figure 5:
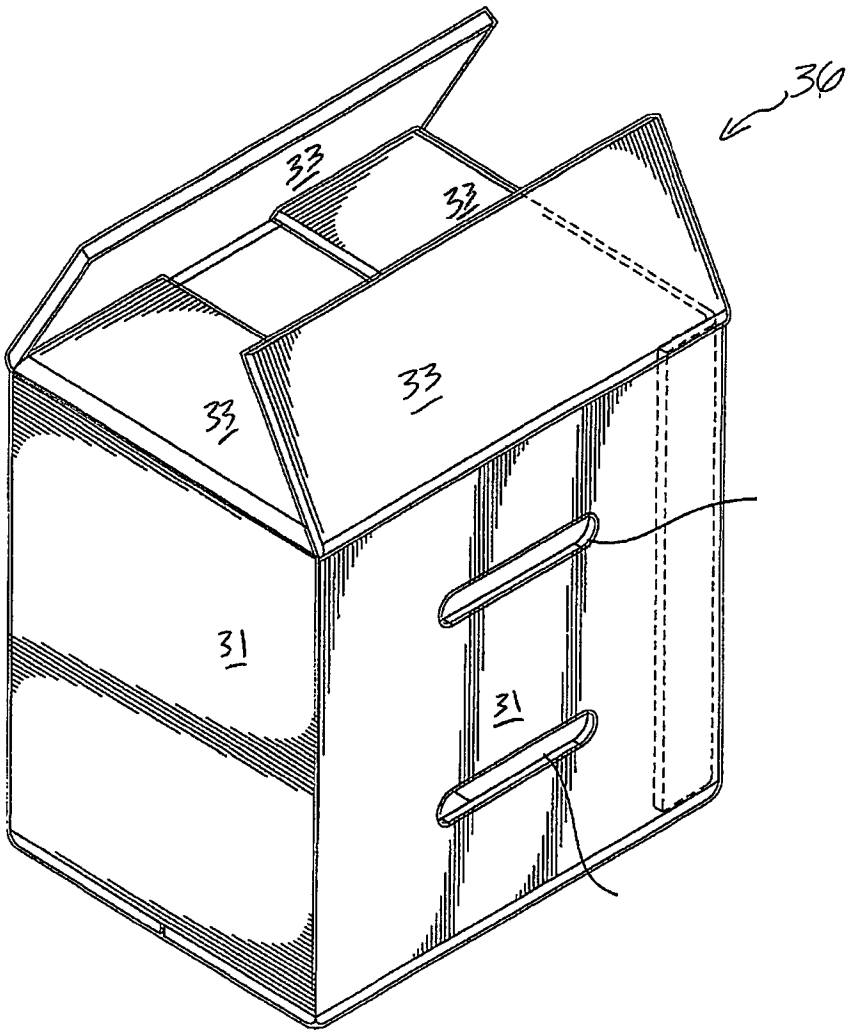
FIG. 5 is another perspective view of a cellulose based material blank of FIG. 4 formed into a container in accordance with another aspect of the present invention.

Referring to FIGS. 4 and 5, a non-limiting example of a cellulose based material includes a container blank 30 that is formable into container 36. Specifically, the container blank 30 is cut, scored, or otherwise formed such that when erected a container 36 is formed. By way of example only, the container blank 30 includes a variety of side panels 31, bottom panels 32 and/or top panels 33 that when erected form a container 36. The blank 30 and container 36 may optionally include cutouts 35 that serve as ventilation orifices, handles, or drainage orifices once container blank 30 is formed into a container 36. While containers blank 30 is illustrated with scores, cutouts and slots, it is understood that such features are not required in accordance with the present invention.

One process for forming the fiber pretreatment aspect of the fist cellulose based material element 22 is described and generally disclosed in FIGS. 6-9. This aspect of the fiber pretreatment process is formed as follows. Before describing this aspect of an embodiment of the present invention in detail, brief comment will be made on the methods used. Where handsheets were prepared, they were made by running about 50 g of fiber through a Valley Beater refiner to the desired freeness as measured by the Canadian Standard Freeness (CFS) test. Consistency was then adjusted to 0.3%. Handsheets were then made conventionally using a Noble and Wood sheet mold that produced sheets 203×203 mm. Formed sheets were pressed initially on a pneumatic press at 275 kPa. This was followed by a second pressing at approximately 690 kPa to achieve linerboard density. This then was followed by two passes through a drum dryer rotating at approximately 4 minutes per pass. Prior to testing sheets were conditioned by a standard Tappi procedure including initial exposure to an atmosphere of 20% R.H. and 20° C. followed by 24 hours at 50% R.H. and 20° C.

Standard test methods were used when appropriate. However, there are no such methods available for measuring repulpability and creep. The methods developed for evaluating these properties will be described.

Repulpability Test

For determining repulpability the product to be tested was cut into strips about 13×150 mm and a 25 g air dried sample of the strips was used. The sample was soaked for 30 minutes in 1500 mL of water at 60° C. and stirred in a large blender on low speed for 4 minutes. The blender was equipped with a clover leaf impeller lacking sharp edges. The mixture was then transferred to a British Disintegrator with 500 mL rinse water and run for 5 minutes. This suspension was then screened on a Valley flat screen having 0.006 inch (0.15 mm) slots and a drain connected to a 100 mesh screen box. Residual material on the screen was collected, placed in an aluminum dish and dried at 105° C. for 24 hours. Dried samples were then weighed and percent rejects calculated. While the test does not give identical results in absolute terms to those found in a given mill there appears to be an excellent correlation.

Creep Test

Constant load edgewise creep in a changing humidity environment is determined by first forming a test cylinder 1 inch (25.4 mm) in diameter and 1 inch high from a strip 78 mm in the machine direction and 50 mm in the cross machine direction The samples are preconditioned 24 hours at 20% R.H. and 23° C. and then conditioned and stored until use at 50% R.H. and 23° C. Four samples are wrapped and held around a 44.5 mm (1.75 inch) mandrel for 16 hours to facilitate cylinder construction. The strips are then wrapped around a 24.8 mm fluorocarbon mandrel to form the test cylinders. Edge deformation is prevented by gluing stainless steel rings outside the cylinder ends so as to leave the 25.4 mm test specimen. Test cylinders have glueless seams that require additional support. This is provided in part by an inner fluorocarbon plastic support 0.962 inches (24.4 mm) in diameter. The outside of the seam is opposed by a restraint system consisting of a fluorocarbon plastic block with a 0.5 inch (12.7 mm) radius face, an aluminum plate, and two extension springs. The fluorocarbon block has slots machined at a 45° angle across the face to facilitate moisture absorption In the test cylinder, moisture absorption occurs at the outer surface. Completed specimens are conditioned in the test fixture at 40% R.H. and 23° C. for i6-17 hours prior to testing. Cylinders are then loaded at 1.92 lb/inch of length (10.25N.multidot.m/m). The relative humidity test cycle consists of a 60 minute ramp up to 93% R.H. and 3 hour hold then a 60 minute ramp down to 40% R.H. and a 3 hour hold. Standard test length was 7 days or 21 full cycles. A non-contact transducer measures sample displacement so that a strain vs. time curve may then be plotted.

Ring Crush

Ring crush is run by TAPPI Test Method T 818 om-87. A 12.7×152.4 mm strip is formed into a cylinder 49.2 mm in diameter. This is placed in a grooved sample holder and top to bottom compression is applied between parallel plates until failure occurs.

Short Span Compression Test

This test is run by Tappi Test Method T 826 pm-92. It is considered by some authorities in the field to give data similar to that of the ring crush test and can be closely related to the compressive strength of corrugated containers. It is intended for containerboard having a span to thickness ratio of 5 or less. This is approximately equivalent to sheets having a grammage of at least 100 g/m$^2$ and not much exceeding 439 g/m$^2$ (20.5-90 lb/msf). Test specimens 15 mm wide are gripped between clamps with an initial free span between the clamps of 0.70 mm. During the test the clamps are moved toward each other at a rate of 3±1 mm/min and load at failure is recorded. Typically a minimum of 10 tests are run in each machine direction, although machine direction is not a criterion for handsheets.

EXAMPLE 1

Figure 6:
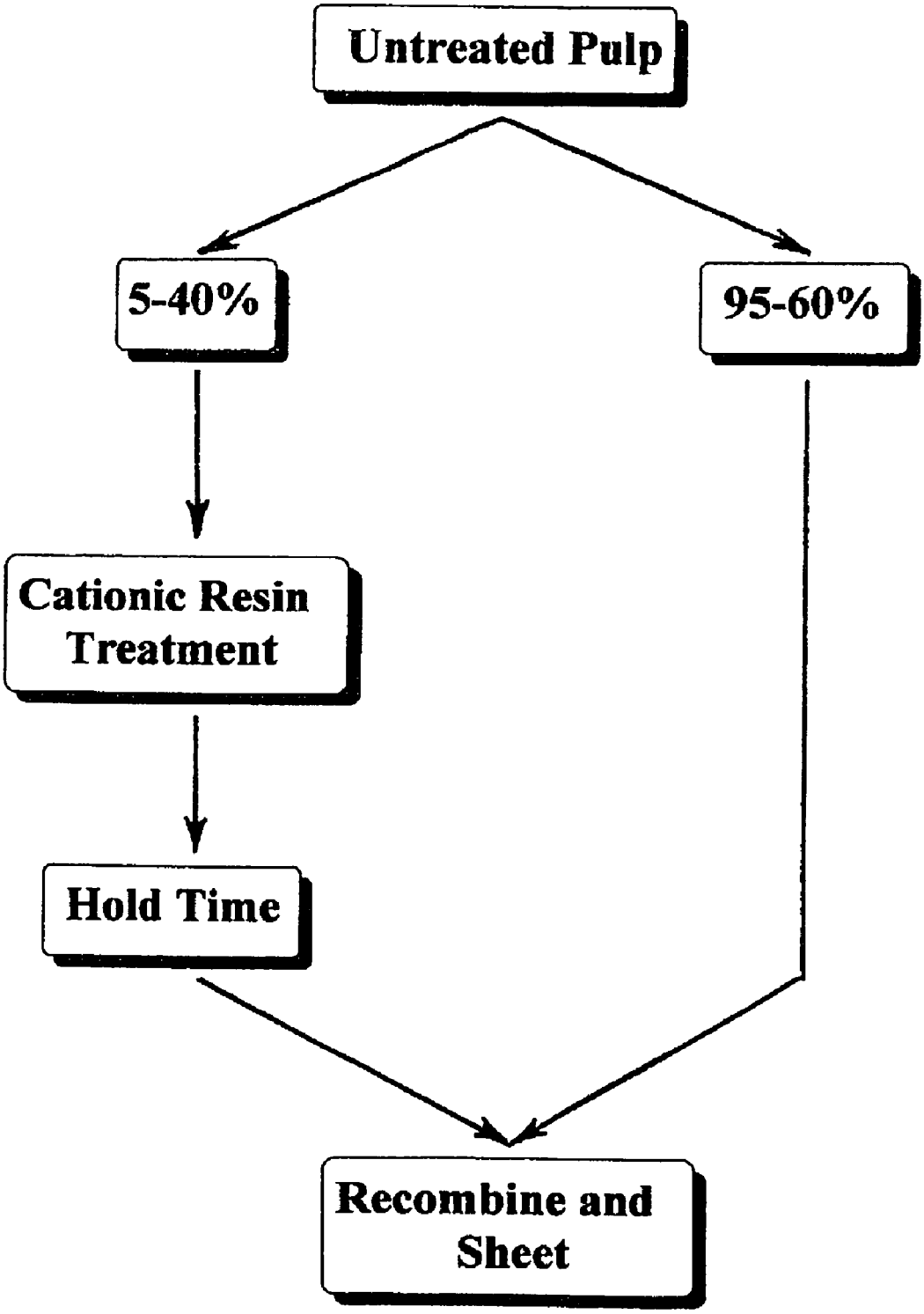
FIG. 6 is a block diagram showing the process of the present method.
Figure 7:
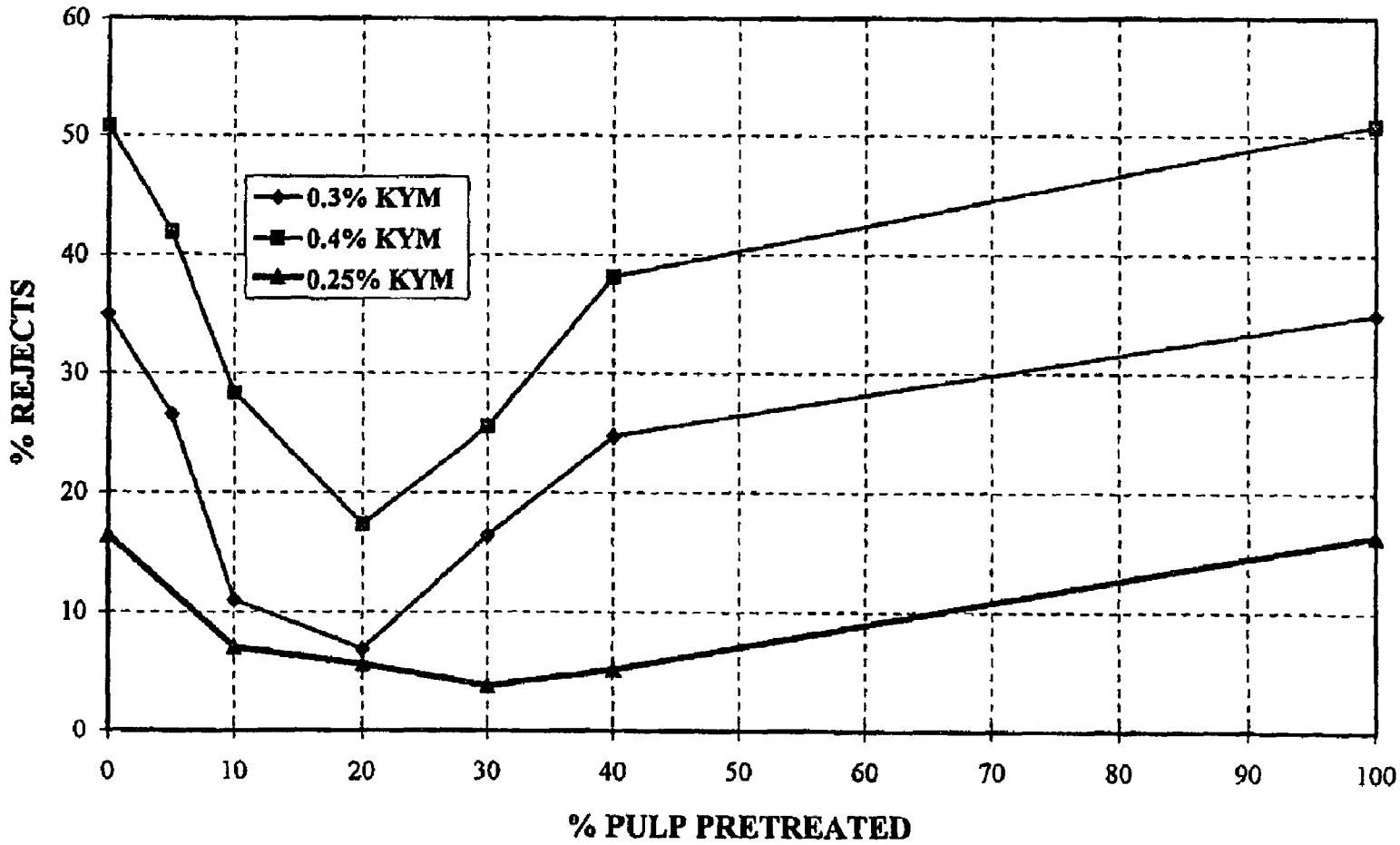
FIG. 7 is a graph showing percent screen rejects vs. the percent of pulp pretreated at three levels of cationic resin usage.

One aspect of an embodiment of the process is outlined on FIG. 6. Untreated pulp furnish to be sheeted is split into two portions. The portion to be pretreated will comprise about 5-40%, preferably 10-30%, of the total furnish. The balance of the furnish is handled conventionally. A cationic crosslinking wet strength resin is then added to the portion diverted to be pretreated in an amount of about 0.5-5.0%. The exact amount used will depend somewhat on the particular percentage of the total fiber being pretreated. In general it should be sufficient to comprise about 0.1-0.6% of the total furnish weight. After a hold time of at least about 30 seconds, preferably about 5 minutes or greater, the pretreated portion is then recombined with the untreated portion of the furnish and thoroughly mixed. From this point the recombined furnish is handled conventionally in all respects.

Four cationic papermaking chemicals were chosen for comparison using the conventional method in which all of the fiber was treated. One was a cationic starch, a product frequently applied internally to enhance dry strength. Another was a low molecular weight polyacrylamide, a product also intended for dry strength enhancement and typically applied internally. The other two materials were polyamide-epichlorohydrin (PAE) resins intended for wet strength improvement. These resins were similar to each other but were the products of different suppliers. The pulp treated was a once dried unbleached western softwood kraft intended for linerboard production. In all cases 100% of the pulp was treated using 0.25% or 0.50% of the additive. No white water was used in preparation of the subsequently made handsheets. The following table shows ring crush values obtained on the various samples after conditioning.

TABLE 1

Effect of Various Cationic Resins on Dry Ring Crush Values and Screening Rejects
Resin Repulping

| Resin Type | Usage, % | Ring Crush, kN/m | Rejects, % |
|---|---|---|---|
| Cationic Starch | 0.25 | 2.31 ± 0.08[1] | — |
| Cationic Starch | 0.5 | 2.36 ± 0.10 | — |
| Polyacrylamide | 0.25 | 2.21 ± 0.19 | — |
| Polyacrylamide | 0.5 | 2.47 ± 0.11 | — |
| PAE #1[2] | 0.25 | 2.63 ± 0.13 | 44 |
| PAE #1 | 0.5 | 2.70 ± 0.10 | 64 |
| PAE #2[3] | 0.25 | 2.83 ± 0.10 | 41.4 |
| PAE #2 | 0.5 | 2.84 ± 0.13 | 57.5 |

TABLE 1-continued

Effect of Various Cationic Resins on Dry Ring Crush Values and Screening Rejects
Resin Repulping

| Resin Type | Usage, % | Ring Crush, kN/m | Rejects, % |
|---|---|---|---|
| Recycled fiber Control | — | 2.22 ± 0.04 | — |
| Virgin Fiber Control | — | 3.04 ± 0.06 | — |

[1]90% Confidence limits
[2]Supplier #1
[3]Supplier #2

Exemplary cationic PAE resins can be obtained From Hercules, Inc., Wilmington, Del., as Kymene® 557H, or from Georgia Pacific Corp., Atlanta, Ga., as Amres® 8855. This is not intended as an endorsement of these particular resins as equally suitable resins may be available from other suppliers.

With the exceptions of the samples having the lower usages of the cationic starch and polyacrylamide resins, all of the treated samples had statistically significant superior ring crush values to an untreated once dried control sample. The PAE treated samples were clearly superior to those made using the cationic starch and polyacrylamide. None of the treated samples reached the value of the never dried virgin fiber sheets. However, the dry strength improvement of the PAE treated samples, as measured by ring crush, compared to the results obtained from untreated once dried fiber was quite dramatic. Repulping rejects on all of the PAE treated samples exceeded 40%. While repulping rejects were not determined on any but the PAE resin treated samples, experience would indicate that screening rejects on all of the others should be very low, normally about 2% or less Thus, while the PAE resins used conventionally as above contribute significant dry strength improvement the resulting high repulping screen rejects makes the treatment unsuitable for general use.

EXAMPLE 2

The previous conventional treatment with PAE resins described in Example 1 was compared with that of the present invention. Sheets were prepared from once dried western softwood kraft fiber without any treatment, with 100% being treated, and with 10% being pretreated with PAE resin then recombined with the 90% untreated fiber. Resin usage was 2.5% by weight on the fiber pretreated, resulting in 0.25% total usage on the recombined fiber.

TABLE 2

Effect of Pretreatment on Short Span Compressive strength and Screening Rejects Short Span Compression

| FiberTreatment[1] | Strength, kN/m | ScreeningRejects,[1] |
|---|---|---|
| No resin treatment | 4.08 ± 0.19[2] | <1 |
| All fiber treated[3] | 5.06 ± 0.44 | 22.9 |
| 10% pretreated[4] | 4.82 ± 0.21 | 2.8 |

[1]Once dried fiber sheeted from fresh water, 161 g/m$^2$ sheet weight
[2]90% Confidence limits
[3]0.25% PAE resin used on treated fiber
[4]0.25% PAE resin used based on total recombined fiber It is evident that a significant improvement in dry strength was obtained on the two samples treated with the PAE wet strength resin. However, repulpability of the sample in which all of the fiber had been treated was very poor with about 23% screening rejects. The dry strength of the other sample was slightly lower but screening rejects were below 3%. Thus, the pretreated sample had an 18% improvement in dry strength with only a minimal increase in rejects when compared with the untreated sheets.

EXAMPLE 3

The amount of the fiber to be pretreated with the cationic wet strength resin can vary widely. Specific amounts will be determined in part by the particular environment in the mill in which the process is carried out. From about 5% to 40% gives generally satisfactory results. However, there is a broad optimum from the standpoint of minimizing screen rejects on repulping in the range of about 10% to 30% of the fiber pretreated. Again, the fiber was once dried western softwood kraft intended for ultimate use as linerboard. This is shown graphically in FIG. 7 for treatment levels of 0.25%, 0.30%, and 0.40%, based on total recombined furnish. A cationic PAE wet strength resin was used in all cases. For the two higher levels of use a marked minimum amount of repulping rejects is noted at a pretreatment level of about 20%. The effect does not appear as dramatic for the lower level of PAE use While the present inventors do not wish to be bound to any particular reason for this behavior, the following explanation is suggested. When only small amounts; e.g., 5% of the pulp is pretreated there appears to be an excess amount of cationic resin for attachment at available anionic sites on the fiber. The excess remains free and is then available for reaction with the fiber that had been withheld when the two portions are recombined. Stated otherwise, the pretreated fiber is treated with the resin to saturation, but the entire balance of the fiber is also treated, albeit to a lower degree. In effect, the entire product has had wet strength treatment. As would be expected, the effect is more noted as the amount of resin used in pretreatment is increased. At the high end of pretreatment, e.g., about 40%, so much of the fiber has been reacted with the resin that the ultimate product will also have achieved an excessively high initial level of wet strength so that repulpability suffers. It must be kept in mind that improved dry strength with good repulpability is the goal of the invention. It is not a primary purpose to produce a product having good wet strength. Means to do that are well known. However, as was noted earlier, an inevitable corollary of wet strength papers made with current practice is that they will have inherently poor repulpability.

Figure 8:
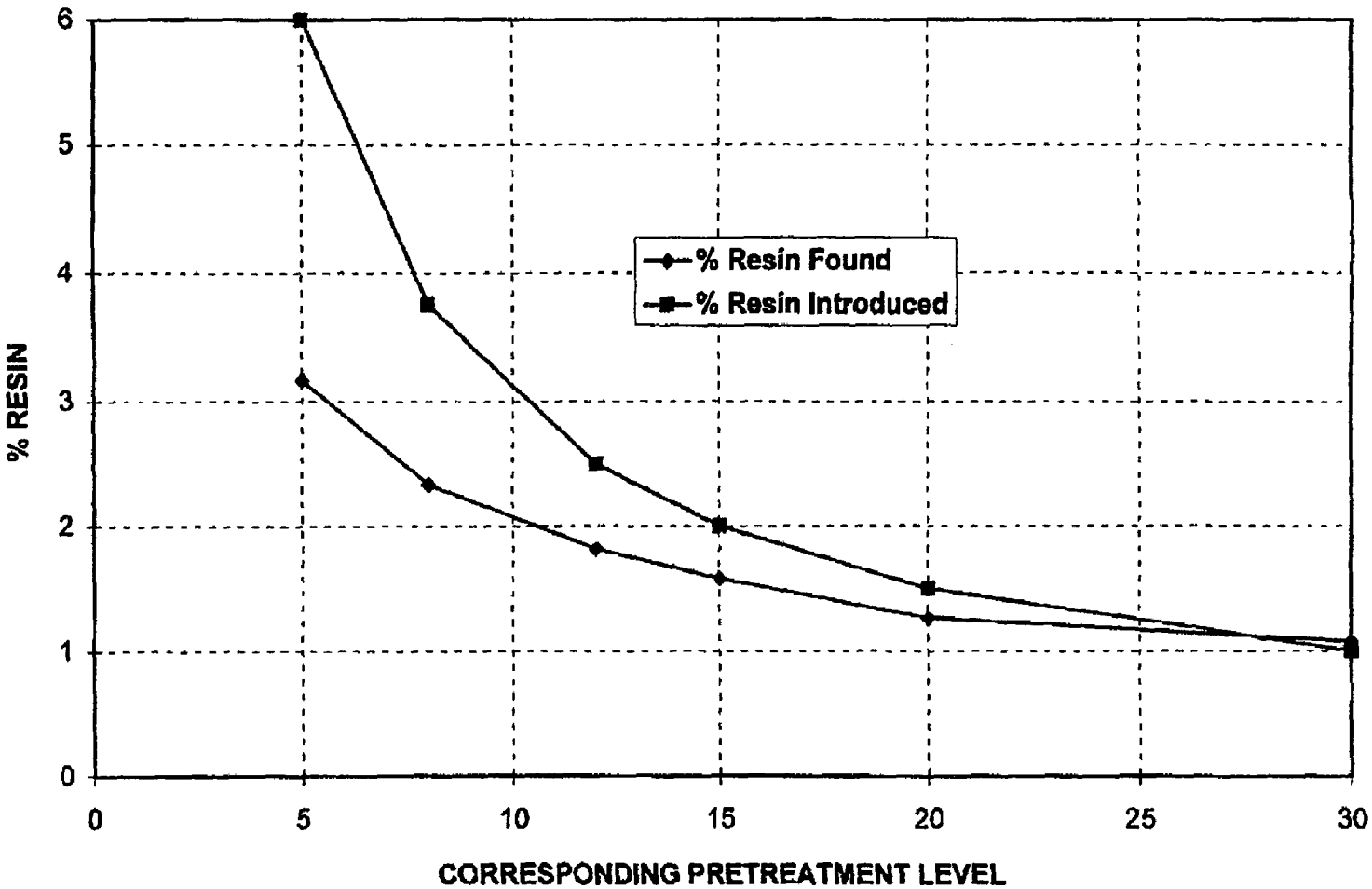
FIG. 8 is a graph showing the amount of cationic resin retained vs. the amount of resin introduced at various pretreatment levels.
Figure 9:
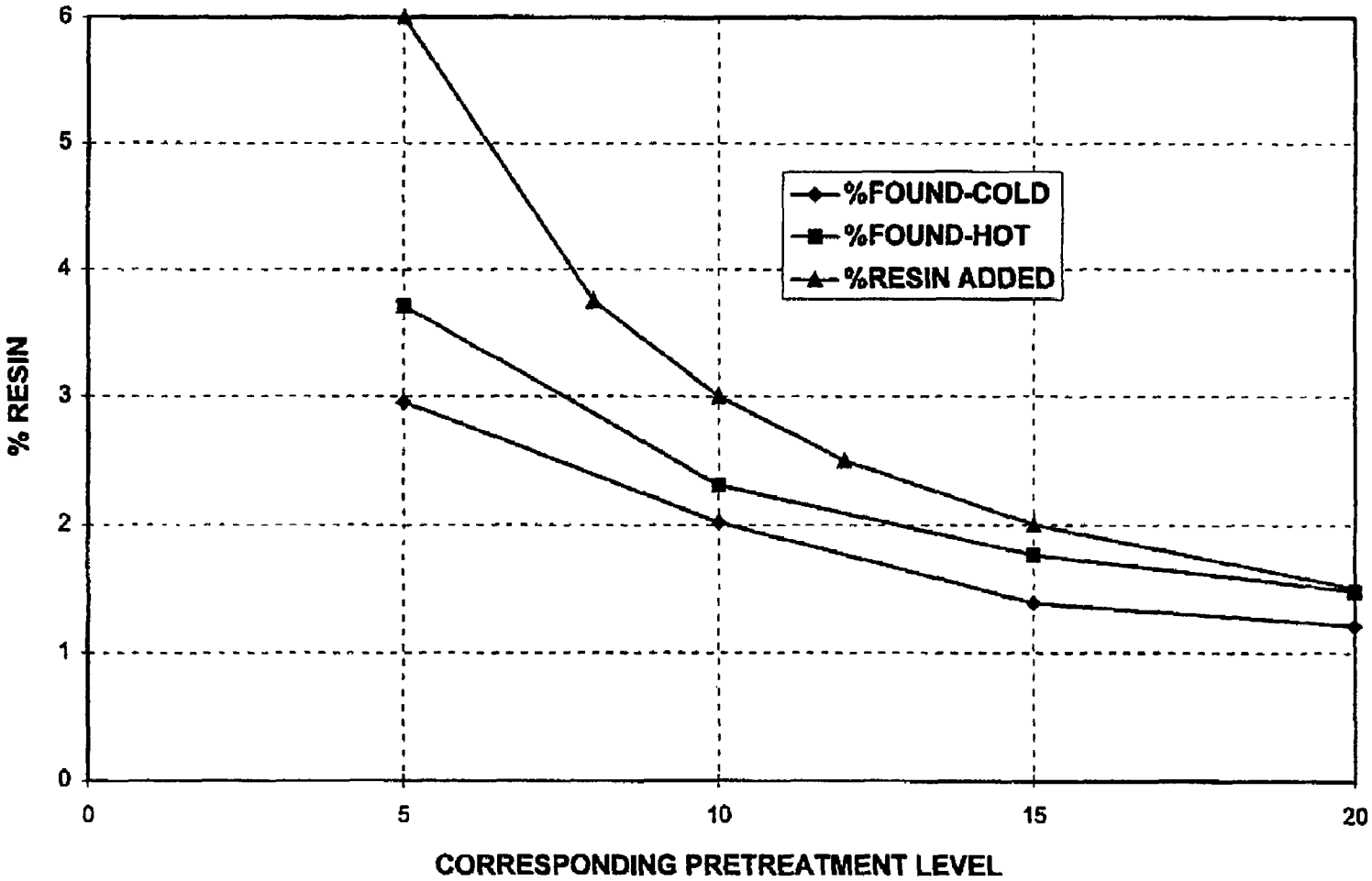
FIG. 9 is a graph showing the effect of pretreatment temperature on cationic resin retention.

Support for the above suggested mechanism is shown by work pictured graphically in FIGS. 8 and 9. Once dried fiber was treated with a cationic PAE wet strength resin in amounts varying between 1% and 6%. These amounts would be equivalent to the resin required at various pretreatment levels in order to achieve 0.3% in the recombined product. After a 5 minute hold time handsheets were made in the usual manner. The resulting sheets were analyzed for nitrogen using the Kjeldahl method and the measured nitrogen content related to the amount of original resin present. FIG. 8 shows that at a very high 6% initial resin usage, corresponding to a 5% pretreatment level, almost half of the original resin is lost in the white water during sheeting. This would have been available to the untreated fiber after the two portions were recombined. At only 1% initial usage, equivalent to a 30% pretreatment level, virtually all of the resin was bonded to the fiber.

Treatment temperature also affects resin retention somewhat with higher temperatures tending to increase retention. All pulp slurries in the study shown in FIG. 8 had been made using approximately room temperature water. Since warm to hot water is commonly used in paper mills at the sheet former a second study was made comparing resin retention in 60° C. water with the approximately 20° C. water used previously. As seen in FIG. 9 retention is improved somewhat at all resin usages although this effect is not dramatic.

EXAMPLE 4

Pretreatment retention time is another variable with some effect on the improvement noted in dry strength of the ultimate product. This factor is another that will be influenced somewhat by individual mill configurations. However, suitable products can normally be made with as little as 30 seconds hold time before the pretreated fiber is recombined with the balance of the furnish. Somewhat longer times are preferred. Normally the hold time after pretreatment should be at least 5 minutes. A small additional effect is seem when holding times are increased to 1-2 hours but little or no further benefit is obtained when holding times are longer than this. The effect of pretreatment time on the amount of screening rejects and short span compression strength is given in the following table.

The mechanism affecting pretreatment time variables is believed to be similar to that just offered in explanation for the optimum amount of fiber to be pretreated. Reaction of the cationic resin with the fiber takes a finite amount of time. When pretreatment times are very short it is probable that complete reaction has not occurred. This will result in unreacted resin being carried over when the pretreated stock is blended with the balance of untreated material. The unreacted resin portion is then free to react in a manner as if it had initially been added to all of the stock.

TABLE 3

Effect of Pretreatment Hold Time

| Hold Time After Treatment[1] | Amount of Total FiberTreated | Screening Rejects, % | Short Span Compression Strength, kN/m |
|---|---|---|---|
| 5 min | 100% | 27.4 | — |
| 5 min | 20% | 6.7 | 3.48 ± 0.067[2] |
| 1 hr | 100% | 26 | — |
| 1 hr | 20% | 1.3 | 3.64 ± 0.097 |
| 2 hr | 100% | 34.3 | — |
| 2 hr | 20% | 2.7 | 3.76 ± 0.046 |
| 4 hr | 100% | 26.5 | — |
| 4 hr | 20% | 1.6 | 3.75 ± 0.163 |
| 24 hr | 100% | 24.2 | — |
| 24 hr | 20% | 0.7 | 3.60 ± 0.092 |
| No treatment | — | <1 | 3.46 ± 0.093 |

[1]Fiber was midcontinent recycled corrugated containers sheeted using recycled white water. Resin usage was 0.3% PAE based on total fiber weight.
[2]90% Confidence limits.

Screening rejects were essentially unchanged throughout when all of the fiber was treated. After 5 minutes pretreatment time this was also the case when 20% of the fiber had been pretreated prior to recombination with the balance of the untreated fiber. The improvement in short span compression strength seen in the sheets made according to the teaching of the present invention is statistically significant.

EXAMPLE 5

One of the very important advantages of the present invention is that the method permits a reduction in sheet basis weight while maintaining dry strength equivalent to products made conventionally using a significant percentage of recycled fiber. This is seen in the data presented in the following table

TABLE 4

Effect of Sheet Basis Weight Reduction on Short Span CompressionStrength Using PAB Resin Pretreatment Process

| Compression Fiber Treatment[1] | Relative Basis Weight | Short Span Strength, kN/m |
|---|---|---|
| Control, no resin treatment | 100% | 2.71 |
| Control, no resin treatment | 90% | 2.44 |
| 100% of fiber PAE treated[2] | 90% | 3.12 |
| 10% of fiber PAE treated[3] | 90% | 3.06 |

[1]Recycled once dried fiber sheeted with clean water
[2]0.25% PAE resin based on total fiber
[3]Sufficient PAE resin used in pretreated portion to give 0.25% base on total recombined fiber Even with a 10% reduction in basis weight the short span compression strength of the product made with pretreated fiber exceeded that of the control sample. While the percentage of screening rejects was not determined on these samples it would be consistent with those shown in the samples of FIGS. 8 and 9.

EXAMPLE 6

One more advantage of the process of the present invention is that it enables achievement of a given level of dry strength at a reduced level of refining. Refining is a major energy consumer in a paper mill. Any means by which it can be reduced will represent a significant cost savings in paper production costs. Sheets made from a fiber obtained from recycled corrugated containers were made with and without resin pretreatment at three refining levels. In the examples of pretreated fiber, 20% of the furnish was treated with 1.5% PAE resin, sufficient to achieve a level of 0.3% in the recombined pulp. Results are given in following Table 5.

TABLE 5

Effect of Refining on Short Span Compression Strength

| Fiber Treatment | Freeness, CSF | Short Span Compression Strength, kN/m | Strength Enhancement, % |
|---|---|---|---|
| Control, no resin Treatment | 608 | 3.43 ± 0.10[1] | — |
| 20% Pretreated[2] | 608 | 3.82 ± 0.13 | 11.4 |
| Control, no resin Treatment | 508 | 3.96 ± 0.09 | — |
| 20% Pretreated[2] | 508 | 4.19 ± 0.14 | 5.8 |
| Control, no resin | 468 | 4.11 ± 0.14 | -pretreatment |
| 20% Pretreated[2] | 468 | 4.22 ± 0.13 | 2.3 |

[1]90% Confidence limits
[2]Sufficient PAE resin used to give 0.3% based on recombined fiber It is evident at all freeness levels that the short span compression strength of the pretreated samples is significantly higher than the samples without any resin treatment. Thus, for any required level of strength, a lower degree of refining will suffice for the sheets made using the pretreatment process.

Burst strength was at one time a major test for evaluating material for corrugated containers. Recently emphasis has been directed more to tests that will be indicative of top-to-bottom compression strength such as ring crush and short span compression strength. However, burst strength is still a property considered extremely important by many customers. In the following test fiber from recycled corrugated containers was continuously sheeted on a Noble and Wood pilot scale paper machine. Wet and dry burst strength was determined among the other tests that were run. In those samples made according to the present invention 20% of the fiber was pretreated with 2.25% PAE resin by weight, sufficient to achieve a level of 0.45% in the recombined furnish.

Mill white water typically contains fine particles from broken fibers and other papermaking materials of an anionic nature which are collectively referred to as "anionic trash". Depending on the particular mill and furnish being processed, it is sometimes necessary to use a cationic charge neutralizer so that this material does not itself remove and reduce the efficiency of subsequent cationic additives intended as fiber substituents. These charge neutralizers are quite conventional papermaking chemicals. Other than improving efficiency of other cationic additives they effect little or no change in properties of the paper itself As noted in the following table, they were used in the quantities listed in preparation of the test samples. All samples were made to equivalent basis weights.

TABLE 6

Effect of PAE Resin Pretreatment on Wet and Dry Burst Strength at Different Refining Levels

| Sample No. | FiberTreatment[1] | PAE Resin Used, % | Test Conditions | Mullen Burst,[5] kPa |
|---|---|---|---|---|
| 1[2] | Unrefined Control | None | Wet | 190 |
| 2 | Unrefined Control | None | Dry | 312 |
| 3 | Unrefined - treated[3] | 0.45 | Wet | 250 |
| 4 | Unrefined - treated | 0.45 | Dry | 399 |
| 5 | Control refined to 520 CSF | None | Wet | 219 |
| 6 | Control refined to 520 CSF | None | Dry | 401 |
| 7 | Treated-Refined to 520 CSF | 0.45 | Wet | 251 |
| 8 | Treated - Refined to 520 CSF | 0.45 | Dry | 421 |
| 9[4] | Control refined to 520 CSF | None | Wet | 216 |
| 10 | Control refined to 520 CSF | None | Dry | 416 |
| 11 | Treated - Refined to 520 CSF | 0.45 | Wet | 250 |
| 12 | Treated - Refined to 520 CSF | 045 | Dry | 440 |

[1]Fiber for all samples was recycled corrugated containers
[2]Samples 1-8 sheeted with 50% white water and 0.1% high charge density cationic resin used as anionic "trash" scavenger
[3]20% of fiber treated with sufficient PAE resin to give 0.45% based on total recombined fiber
[4]Samples 9-12 sheeted with clean water and 0.05% high charge density cationic resin used as aniomc "trash" scavenger
[5]Tappi Method T807 om94

It is readily evident that in every case both wet and dry burst strength of the pretreated samples was superior to that lacking the PAE resin pretreatment of 20% of the furnish.

EXAMPLE 7

In present mill practice it is quite common for linerboard furnish to be a mixture of virgin and recycled fiber; e.g., old corrugated containers and other recycled paper products. As was noted earlier, the improvement in dry strength imparted by the process of the present invention is more marked with recycled fiber than with virgin fiber. However, dry strength improvements are seen in products made from all virgin fiber as well as in mixtures as the following table will show.

TABLE 7

Effect of Virgin/Recycled Fiber Ratio on Short Span Compression Strength

| Virgin Fiber in Furnish, %[1] | Fiber Treated with PAE Resin, %[2] | Short Span Compresion Strength, kN/m | Strength Enhancement % |
|---|---|---|---|
| 100 | 0 | 4.47 ± 0.09[3] | — |
| 100 | 20 | 4.76 ± 0.11 | 6.5 |
| 90 | 0 | 4.25 ± 0.08 | — |
| 90 | 20 | 4.66 ± 0.11 | 9.6 |
| 70 | 0 | 3.98 ± 0.11 | — |
| 70 | 20 | 4.50 ± 0.10 | 13.1 |
| 50 | 0 | 3.77 ± 0.13 | — |
| 50 | 20 | 4.34 ± 0.07 | 15.1 |
| None | 0 | 2.74 ± 0.06 | — |
| None | 20 | 3.52 ± 0.09 | 28.5 |

[1]Balance of fiber is recycled corrugated containers
[2]Sufficient PAE resin used in all cases to give 0.3% based on total fiber
[3]90% Confidence limits While improvement in short span compression strength using the PAE pretreatment is seen in all pairs, the magnitude of improvement becomes significantly greater as the amount of recycled fiber in the furnish is increased.

EXAMPLE 8

One cause of failure of corrugated containers is creep, the gradual top-to-bottom slumping encountered when stacked filled containers are subject to cyclic temperature and humidity change. Wet strength treated board is resistant to creep but, as was noted earlier, is difficult to repulp without significant screening loss. The fiber used for the following tests was western softwood kraft. Material used for the tests was fiber from old corrugated containers. Even though it is not intended to achieve improved wet strength, as will be seen in the following table the treatment of the present invention effects a significant improvement in creep resistance.

TABLE 8

Effect on Creep Rate Using Resin Pretreated Fiber

| Fiber Treatment[1] | Secondary Creep Rate, Creep Strain/day[2] |
|---|---|
| No resin treatment | 0.00179 ± 0.00066 |
| All fiber treated[3] | 0.00114 ± 0.00037 |
| 20% Pretreated[4] | 0.00133 ± 0.00043 |

[1]Recycled corrugated container fiber
[2]Based on 12 tests
[3]0.3% resin used based on total fiber
[4]0.3% resin used based on total recombined fiber

EXAMPLE 9

The earlier examples were primarily directed to paper products such as linerboard for corrugated containers. Little or no mineral fillers are present in these papers. This is not the case with so-called fine papers and many other paper products. These normally have filler contents up to about 20% by weight. In some papers filler content may be much higher. Fillers are used to contribute smoothness and opacity and to reduce cost since they are usually less expensive on a volume basis than virgin cellulose fiber. As filler content increases strength normally decreases due to interference of the filler particles with the interfiber bonding mechanism. The most usual fillers are kaolin clays or precipitated calcium carbonate. Both are anionic materials which are frequently chemically modified by the suppliers to have specialized surface characteristics for particular grades of paper.

Printing qualities of fine papers are influenced not only by the fillers present but by sizing and subsequent surface treatment. Many are treated with starch at the size press. However, the type and location of the size press affect the z-direction distribution of starch into the sheet. Starch distributed across the thickness contributes significant internal bond strength to the sheet. However, if Z-direction strength could be improved otherwise starch could be concentrated near the sheet surface where it would have the most beneficial effect on print quality.

A very significant percentage of fine papers enter the recycle stream. The fiber is subject to the same deterioration in strength noted earlier for recycled corrugated containers. Thus some means of improving paper strength other than by starch additives would be very beneficial. The process of the present invention provides such a means.

Handsheets were prepared using a western bleached pulp with a 65:35 weight ratio of hardwood to softwood fiber. To this was added 20% by weight of scalenohedral precipitated calcium carbonate and 0.38 kg/t of a cationic retention aid. Cationic potato starch was also added at a rate of 5 kg/t. The furnish was divided into portions and 2.25% by weight cationic PAE resin was added to 20% of the stock. This was sufficient to achieve 0.45% by weight of the entire solids in the furnish. In one sample the PAE resin was added prior to addition of the other additive materials and in another sample the PAE resin was added subsequently. Results are seen in the table that follows. Scott bond is a measure of the internal bond of the sheet.

TABLE 9

Effect of Cationic PAE Resin Addition Point on Scott Bond Strength

| PAE Resin Addition Point | Scott Bond, J/m[2] | Standard Deviation |
|---|---|---|
| Control - no PAE resin | 221.71 | 9.77 |
| Added to fiber before other additives[1] | 233.27 | 19.01 |
| Added after starch, filler and retention aid[1] | 326.57 | 24.05 |

[1]All of he PAE resin was added to 20% of the furnish in am amount t give 0.45% based on the recombined fiber and filler
[2]Tappi Method UM 403

A second experiment was conducted in which only the second condition was examined; i.e., PAE resin added to 20% of the furnish only after all other additives. A number of other properties were evaluated as shown in Table 10.

TABLE 10

Effect of Cationic PAE Resin Pretreatment on Paper Physical Properties

| Condition % | Scott Bond, J/m$^2$ | Z-Direction[2], kpa | Tensile Index[3], N m/g | Total Energy Absorption[3], J/m$^2$ | Ash, |
|---|---|---|---|---|---|
| No PAE resin used | 258.06 | 492.99 | 32.50 | 0.734 | 18.7 |
| 20% treated[1] | 347.59 | 557.34 | 44.42 | 1.18 | 18.7 |

[1]20% of the furnish was treated with sufficient PAE resin to give 0.45% based on the recombined weight of fiber and filler
[2]Tappi Method TM 541 om89
[3]Tappi Method TM494 om88

It is seen that in all cases the properties were significantly improved using the pretreatment process of the invention.

EXAMPLE 10

Along with dry strength improvement, it has been noted that there is often a significant improvement in wet strength as well. This was apparent in the data of Table 6 but is seen better in the following test. Recycled east coast corrugated containers were repulped and treated with PAE resin at a level of 0.4% based on total fiber. Resin treatment was carried out on 20% and 100% of the fiber at ambient temperature and at 49° C. The pulp was refined to a freeness of 500 csf prior to treatment. Pretreatment time was 5 minutes before recombination with the untreated fiber. Handsheets were prepared as described previously at 0.3% consistency using fresh water for pulp dilution. Basis weight was 200 g/m$^2$ and sheet density about 650 kg/m$^3$. Both dry and wet tensile index were measured. Results of the tests are seen in the following Table.

TABLE 11

Effect of PAE Treatment on Dry and Wet Tensile Strength

| Sample | Fiber Treated, % | Treatment Temperature | Tensile Index, Dry, N · m/g[1] | Tensile Index, Wet, N · m/g[2] |
|---|---|---|---|---|
| Untreated | 0 | Ambient | 50.4 ± 1.0 | 2.4 ± 0.1 |
| Pretreated | 20 | Ambient | 55.7 ± 1.7 | 11.8 ± 0.5 |
| Standard | 100 | Ambient | 59.5 ± 2.4 | 27.9 ± 1.1 |
| Untreated | 0 | 49° C. | 51.6 ± 1. | 12.3 ± 0.2 |
| Pretreated | 20 | 49° C. | 57.7 ± 1.4 | 10.6 ± 0.6 |
| Standard | 100 | 49° C. | 57.2 ± 2.2 | 14.5 ± 0.7 |

[1]Tappi method T494 om88
[2]Tappi method T456 om87

Significant increases in both dry and wet strength are seen using the pretreatment process. For the pretreated fiber the wet/dry ratio was 0.21 for the ambient temperature treatment and 0.18 for treatment at 49° C. The recognized standard for a wet strength sheet is a ratio of 0.15 or greater. Thus, for some furnishes the pretreatment process does provide a wet strength sheet even though the strength is somewhat lower than when 100% of the pulp is treated. While the test for screening rejects was not run on the above samples, based on experience; e.g., Tables 2 and 3, screening rejects would be expected to be in the range of 2-3% for the pretreated sheets and 15+% for the sheets having 100% of the fiber treated.

An additional aspect of an embodiment of the present invention includes another method of forming the fiber preteated first cellulose based material element 22. This method, like the first described above, provides a method for treating fiber to achieve wet strength while retaining repulpability and/or recyclability. In this embodiment, another papermaking process is provided. This process has a first flow line which contains secondary fiber in the form of, for example, old corrugated containerboard ("OCC"). As discussed above, secondary fiber may be defined as fiber which has been dried at least once. In an embodiment, a portion of this line is separated into a second line and is treated with cationic resin. A third, and separate, line contains virgin fiber. Virgin fiber may be defined as a predominance of cellulosic fiber which has never been dried after a pulping process. The virgin fiber line is combined with the untreated secondary fiber in the first flow line. The treated portion is then recombined with the mixed product of the first line and the virgin fiber line. Products made from the combined flow lines demonstrate wet strength as well as sufficient repulpability. Moreover, separation of the virgin fiber from the secondary fiber provides the system with less cationic demand. Accordingly, less resin is required to treat the secondary fiber.

Figure 10:
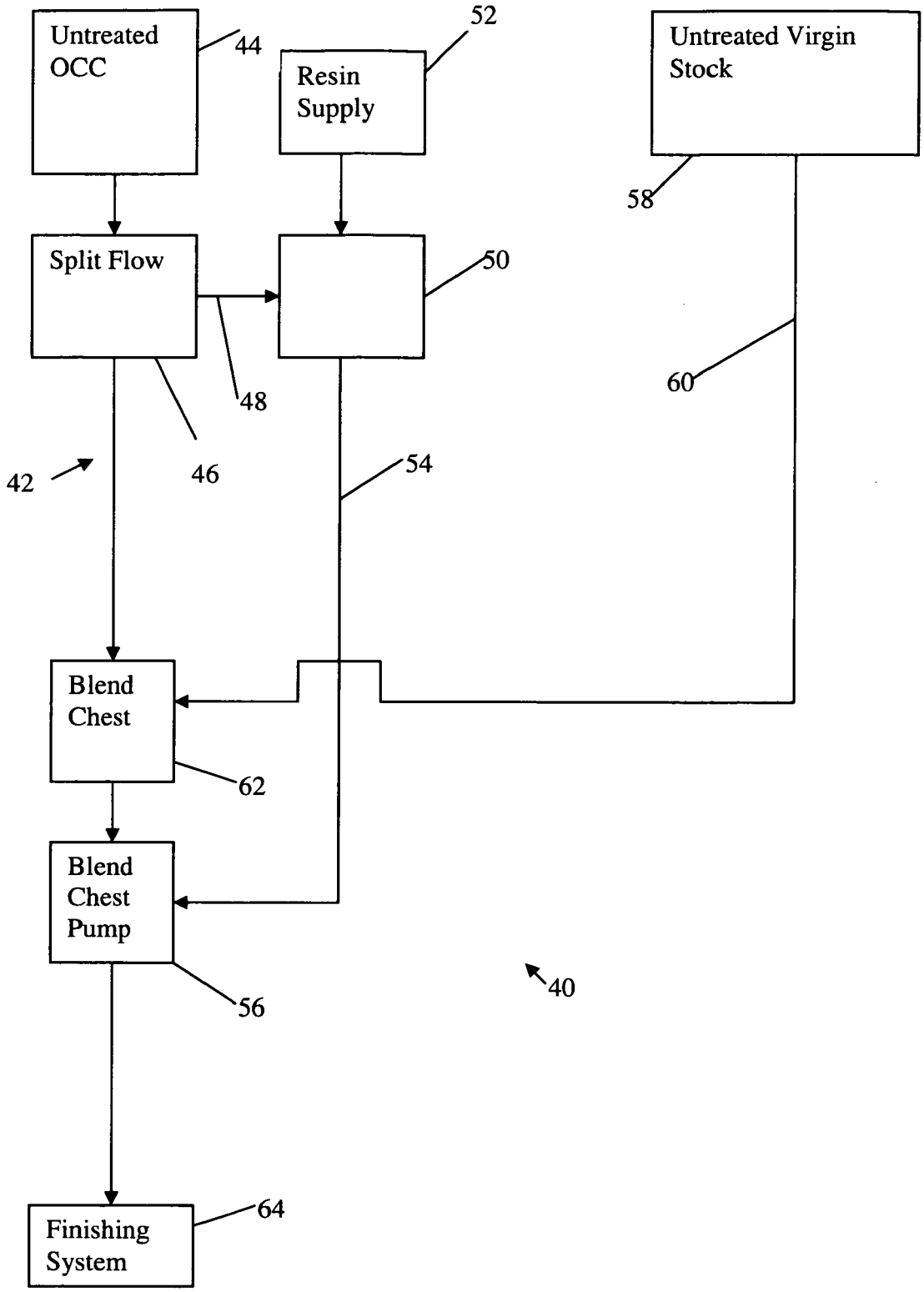
FIG. 10 is a diagram of a system for fiber treatment in an embodiment of the present invention.

Referring now to the drawings wherein like numerals refer to like parts, FIG. 10 illustrates a system 40 which may be used to produce a base sheet having a first line 42 into which is fed secondary fiber in the form of, for example, untreated OCC from a supply or furnish 44. A flow rate extending from the furnish 44 may be in a range from 2500 gpm to 4500 gpm. Moreover, the secondary fiber supplied may represent 10-40% of the total fiber in the system. At point 46, line 42 may be split into separate lines wherein the line 42 is untreated and wherein the line 48 is treated with a cationic resin treatment at a point 50. The resin may be provided from a supply 52. A flow rate for the line 48 may be in a range from 500 gpm to 3000 gpm. Examples of resins which may be utilized are cationic polyamide-epichlorohydrin (PAE) resins, as well as cationic urea-formaldehyde (UF) and melamine-urea-formaldehyde (MUF) condensation products. In an embodiment, the OCC and/or other secondary fiber which has been drawn off from line 42 is treated with, for example, KYMENE®. A mix time for the cationic treatment may be in a range from 30 seconds to 90 seconds.

The treated secondary fiber travels along line 54 to a blend chest pump 56 at a flow rate in a range from 1500 gpm to 2000 gpm. Approximately 20-30% of the total flow exiting the blend chest pump 56 consists of treated secondary fiber. More specifically, the total flow exiting the blend chest pump 56 may include untreated secondary fiber and/or treated secondary fiber and/or virgin fiber. Of this total flow, 10-40% may be treated secondary fiber; 5% to 50% may be untreated secondary fiber; and 60% to 90% may be virgin fiber.

A virgin fiber furnish 58 provides a line 60 of virgin fiber to the blend chest 62 at a flow rate in a range from 5400 gpm to 7500 gpm. More specifically, the virgin fiber supplied may represent 60-90% of the total fiber in the system. At the blend chest 62, the virgin fiber may be mixed with the untreated secondary fiber flowing from the line 42. The mix time for the virgin fiber and the untreated secondary fiber is in a range from 5 minutes to 20 minutes. Next, the combined virgin fiber and untreated secondary fiber is mixed with the treated secondary fiber line 54 at the blend chest pump 56. A mix time for the combination of the lines 42, 48 and 60 is in a range from 1 minute to 3 minutes. The entire mixture may then be transferred to a system 64 for drying and/or pressing and/or other finishing activities.

In an embodiment, the line 48 of secondary fiber which is treated may be supplied by an independent stream rather than split from the line 42. In an embodiment, a furnish used to supply the line 48 may be different than a furnish used to supply the secondary fiber in the line 42. The independent line may be treated with cationic resin prior to combination with the secondary fiber line 42 and the virgin fiber line 60 in a manner similar to that described above. Flow rates may be adjusted to create the system parameters outlined above. For example, the flow rate of the independent line may be adjusted wherein the treated secondary fiber accounts for 20-30% of the total fiber exiting the blend chest pump 56. In another embodiment, a single line of secondary fiber may be supplied. This line may be treated with a cationic resin treatment and combined with virgin fiber. In this embodiment, the virgin fiber line may be combined with only treated secondary fiber.

Figure 12:
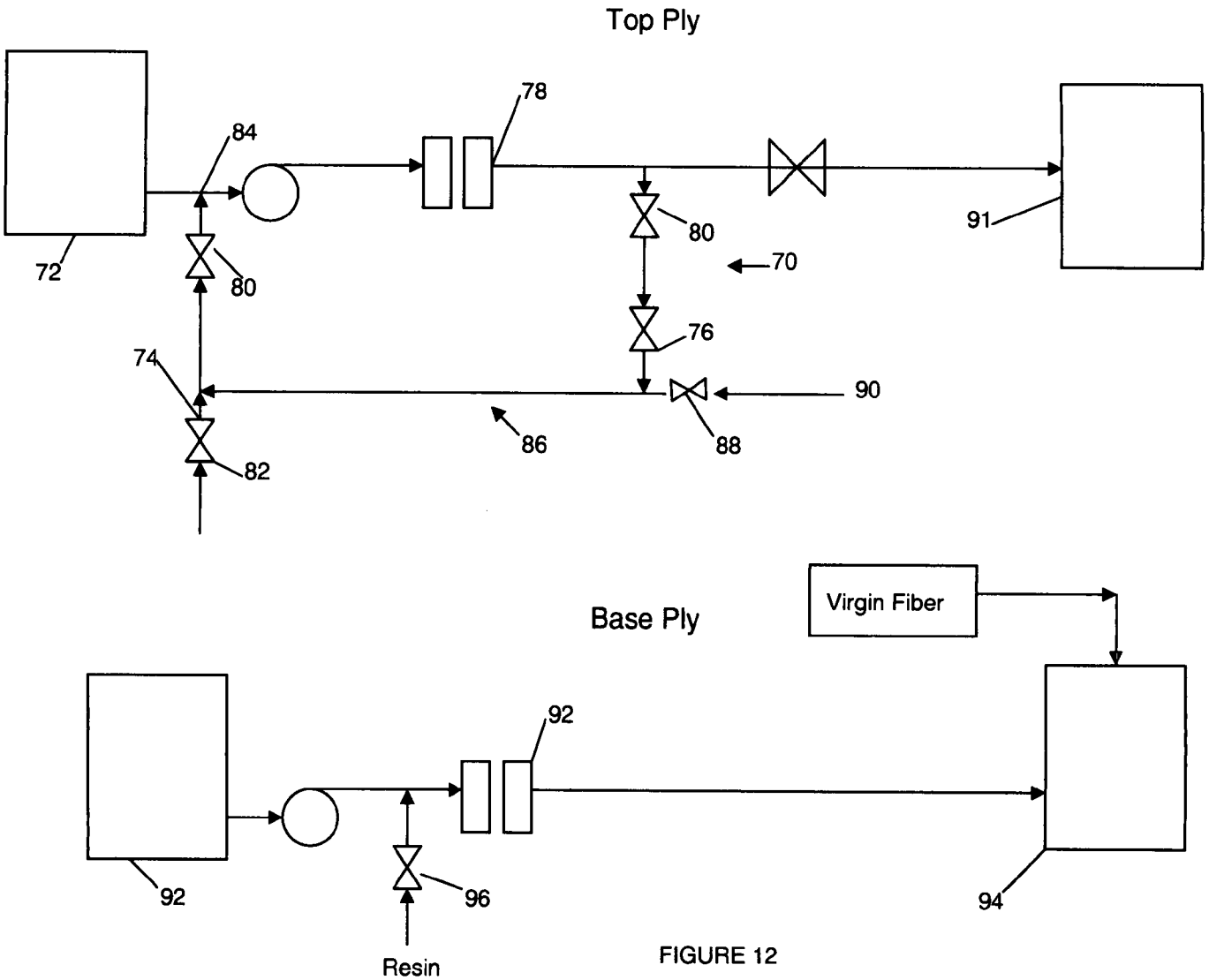
FIG. 12 is a diagram of a system for fiber treatment in an embodiment of the present invention.

EXAMPLE 12, illustrated in FIG. 12, describes an embodiment of the present invention in which fiber was treated to provide a product having wet strength and adequate repulpability. More specifically, in the example below, the objective was to produce paper with wet strength, and normal repulpablility. To achieve this, 15% to 25% of the furnish was treated with a strong dose of wet strength resin. The treated portion gave the sheet 50% to 70% of the strength found in a normal wet strength sheet. The sheet was considered repulpable because only 20% of the sheet was treated with wet strength resin. It should be understood that, although EXAMPLE 12 describes an embodiment in which all of the secondary fiber is treated, this should not be construed to limit any embodiments in which a portion of the total amount of secondary fiber used is untreated.

EXAMPLE 12

In this embodiment, top sheet wet strength was added to a top tickler pressure relief line 70 using AMRES®. A tank 72 provides a supply of virgin fiber for the top ply of product. In a first step, the air was bled from the pressure relief line 70 at a point 74. This was performed by opening a pressure control valve 76 to 50% output. This is the pressure relief line 70 from the top tickler outlet 78. Next, isolation valves 80 on each side of an automatic pressure relief valve 76 were opened.

A 1.5" flush valve 82 was opened on the pressure relief line 70 just above an entry point in the machine chest pump suction 84. This was performed for a duration sufficient to bleed the air from a pressure recirculation line 86. The isolation valve 80 from the top tickler pressure relief valve 76 was opened at the top machine chest pump suction 84. A 250 to 300 gpm difference was established between the top basis weight flow and the top tickler flow. The valve 88 on the wet strength resin addition point 90 was opened. A 2#/ton wet strength addition was then established. The top tickler power was minimized as shear may reduce wet strength resin efficiency. The wet strength addition set point was increased to 6#/ton at a point in the process which was 2 reels before starting the order. Wet strength addition was adjusted to control test. The virgin fiber in this process was delivered to a blend chest 91.

Base sheet wet strength resin was added before the OCC refiner 92. To this end, the total OCC flow from a tank 94 was set at 20% of the base basis weight flow (1600 to 1900 gpm). The OCC flow controller (not shown) was set to manual because the wet strength resin may negatively influence the flow indication. The flow indicator (not shown) from the OCC refiner 92 can be used for control. As shown in the FIGURE, treated secondary fiber and virgin fiber are mixed in a blend chest 94. The base blend chest level set point was reduced to meet the residence time requirement in the chest because excessive mix time may reduce wet strength resin efficiency. The valve 96 on the wet strength resin addition point was then opened. A 2#/ton wet strength addition was then established.

The wet strength addition set point was increased to 6#/ton at a point 2 reels before starting the order. Wet strength addition was adjusted to control test. The system was then flushed. To this end, the wet strength addition rate was reduced to 2#/ton. The suction valve (not shown) on the wet strength supply tank (not shown) was then closed. Next, the flush water valve (not shown) was opened for sufficient time to flush the system of resin. The wet strength pump (not shown) was stopped after the flush was complete. The isolation valves (not shown) at the base and top addition points were closed when the flush was complete.

Figure 11:
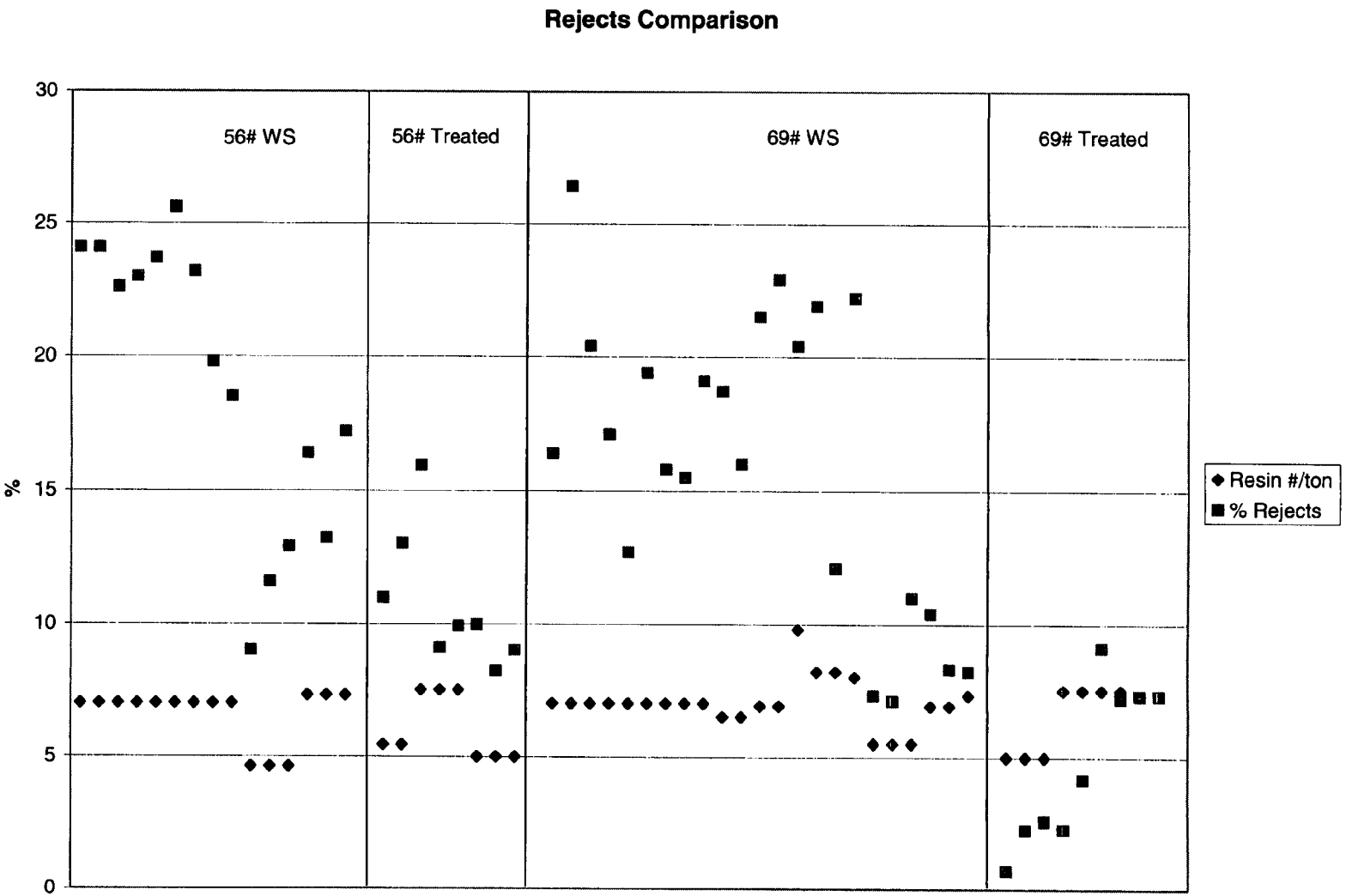
FIG. 11 is a chart of reject comparison for products manufactured via a conventional method and products manufactured via at least one of the methods of the present invention.

FIG. 11 illustrates a chart of a comparison of product rejects based on conventional methods of paper manufacturing and methods of the present invention. In the embodiments of the present invention, a portion of secondary fiber is treated with cationic resin prior to combination with virgin fiber. In FIG. 11, the square-shaped symbols represent a percentage of rejects for a set of rolls which were produced. The diamond-shaped symbols represent an amount of resin used per ton to treat the system. Each diamond-shaped symbol corresponds to each square-shaped symbol, as they represent a trial collectively. From FIG. 11, it can be seen that those products in which a portion of secondary fiber was treated prior to combination with virgin fiber provided less rejects. Thus, these embodiments demonstrated greater repulpability on average. Moreover, the products of the present invention required less resin, on average, in comparison to conventional products. This is due to the separation of the virgin fiber line from the secondary fiber line. This separation may prevent any possible reaction between the anionic byproduct associated with the virgin fiber and any cationic resin added to the system to treat the secondary fiber. For example, in conventional systems, a line combining secondary fiber and virgin fiber may have a charge of 0.3-3.0 meq/L. However, in the present invention, a secondary fiber line, prior to combination with the virgin fiber, may have a charge in a range from 0.1-1.0 meq/L. Accordingly, less resin is necessary to treat the secondary fiber.

Table 12 shows data in a comparison between products prepared using conventional methods (denoted "WS") and products prepared using at least one of the methods of the present invention (denoted Reels 1, 2 and 3).

TABLE 12

| | Unit | Reel 1 | Reel 2 | Reel 3 | WS |
|---|---|---|---|---|---|
| Basis Weight | Lbs/MSF | 57.0 | 56.6 | 56.8 | 56.1 |
| Caliper | Points | 15.6 | 15.2 | 15.5 | 15.0 |
| Density | $kg/m^3$ | 705.5 | 719.5 | 705.4 | 722.3 |
| Mullen | $Lbs/In^2$ | 120.9 | 124.2 | 112.4 | 127.4 |
| Mullen Wet | $Lbs/In^2$ | 39.7 | 40.7 | 41.4 | 39.4 |
| Repulpability - Rejects | % | 5.5 | 4.7 | 6.2 | 28.6 |
| STFI - CD | Lbs/In | 33.9 | 36.6 | 35.7 | 31.5 |

As can be seen in the table, the method of the present invention enables wet strength grade products. Moreover, the present invention allows for greater repulpability, as evidenced by the considerably fewer percentage of rejects.

It will be appreciated by those skilled in the art that having a cellulose sheet 20 that includes a first cellulose based material element 22 that is formed from cellulose fiber having gone through one of the above processes in combination with a second cellulose based material element 24 that is not formed by one of the above mentioned pre-treatment processes has its advantages. A cellulose sheet 20 manufactured in this manner may be less expensive than a cellulose sheet all made from fiber having the properties the first cellulose based material element 22. Likewise, there may be a other benefits as well.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A multi-ply paperboard comprising:

a first board layer that includes from 5-40% of fibers treated with 0.5-5.0% of a reactive crosslinking wet strength resin blended with 60-95% of untreated fibers, said wet strength resin being at least partially crosslinked; and a second board layer connected with said first board layer, said second board layer consisting of fibers not treated with said crosslinking wet strength resin.

2. The multi-ply paperboard of claim 1, wherein said wet strength resin is selected from the group consisting of urea-formaldehyde condensation products, melamine-urea-formaldehyde condensation products and polyamide-epichlorohydrin reaction resins.

3. The multi-ply paperboard of claim 2, wherein said wet strength resin is a polyamide-epichlorohydrin reaction resin.

4. The multi-ply paperboard of claim 1, wherein one or both of said first and second board layers is substantially flat or fluted.

5. The multi-ply paperboard of claim 1, further comprising a third board layer connected to one or both of said first or second board layer.

6. The multi-ply paperboard of claim 5, wherein said third board layer comprises fibers treated with said reactive crosslinking wet strength resin.

* * * * *